US009663331B2

(12) United States Patent
Buhlmayer et al.

(10) Patent No.: US 9,663,331 B2
(45) Date of Patent: May 30, 2017

(54) LIFTING DEVICE WITH AN ADJUSTABLE CARRIAGE

(75) Inventors: Reiner Buhlmayer, Pfedelbach (DE); Jurgen Weingartner, Kocherstetten (DE)

(73) Assignee: KONECRANES PLC, Hyvinkaa (FI)

( * ) Notice: Subject to any disclaimer, the term of this patent is extended or adjusted under 35 U.S.C. 154(b) by 863 days.

(21) Appl. No.: 13/995,644

(22) PCT Filed: Dec. 19, 2011

(86) PCT No.: PCT/EP2011/073229

§ 371 (c)(1),
(2), (4) Date: Jun. 16, 2014

(87) PCT Pub. No.: WO2012/084816

PCT Pub. Date: Jun. 28, 2012

(65) Prior Publication Data

US 2014/0291271 A1 Oct. 2, 2014

(30) Foreign Application Priority Data

Dec. 22, 2010 (DE) ..... 10 2010 013 182
Dec. 22, 2010 (DE) ..... 10 2010 061 462

(51) Int. Cl.
*B66C 11/06* (2006.01)
*B66C 9/02* (2006.01)

(52) U.S. Cl.
CPC ..... *B66C 11/06* (2013.01); *B66C 9/02* (2013.01)

(58) Field of Classification Search
CPC ..... B66C 9/02; B66C 11/06; B66C 19/00
USPC ..... 105/148, 154; 212/328, 346
See application file for complete search history.

(56) References Cited

U.S. PATENT DOCUMENTS 2,744,472 A * 5/1956 Symons ..... E04G 3/28 105/154
3,017,958 A * 1/1962 Richter ..... B66C 7/00 105/150
4,343,240 A * 8/1982 Nishimura ..... F16B 21/12 105/54
6,516,728 B1 * 2/2003 Muller ..... B61B 13/04 104/137
8,783,189 B2 * 7/2014 Gouault ..... B61B 13/04 104/95

(Continued)

FOREIGN PATENT DOCUMENTS

FR WO 2009156587 A1 * 12/2009 ..... B61B 13/04
GB 2128566 A * 5/1984 ..... B61B 13/04

(Continued)

OTHER PUBLICATIONS

International Search Report; Date of Actual Completion Feb. 20, 2012.

*Primary Examiner* — Zachary Kuhfuss
(74) *Attorney, Agent, or Firm* — R. S. Lombard

(57) ABSTRACT

The lifting device according to the invention comprises a carriage (16) and a lifting unit (17), which are connected to each other by means of linear guides (29, 30). The carriage (16) comprises two side parts (19, 20) that can be adjusted in view of their distance relative to each other by means of a distance adjustment device (36). In doing so, they are centered by means of a centering device (45) with respect to the lifting unit (17), in particular with respect to the pulling means originating from the lifting unit (17).

15 Claims, 6 Drawing Sheets

(56) References Cited

U.S. PATENT DOCUMENTS

Figure 1:
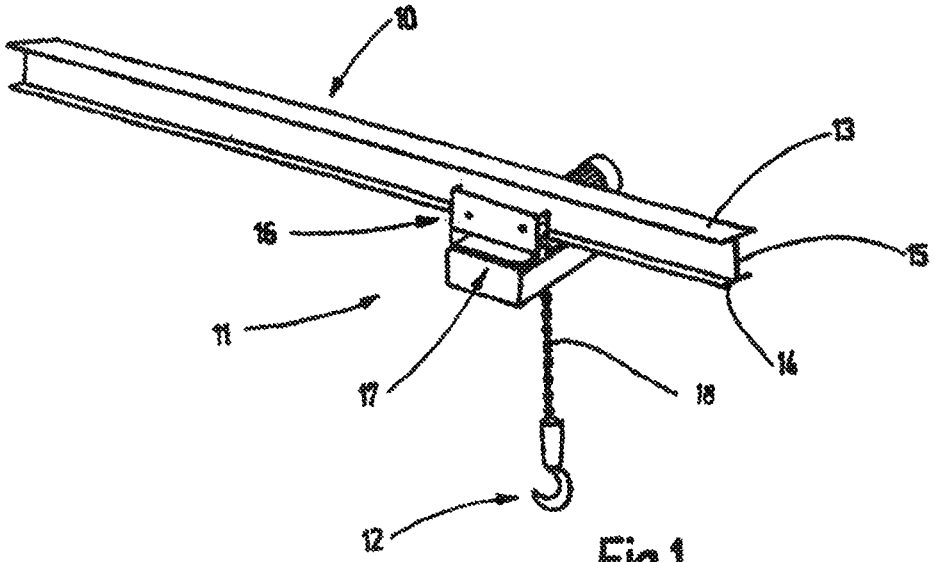

| | | | | |
|---|---|---|---|---|
| 2007/0094792 | A1* | 5/2007 | Sims, Jr. | A47C 21/006<br>5/109 |
| 2011/0089129 | A1* | 4/2011 | Gouault | B61B 13/04<br>212/71 |

FOREIGN PATENT DOCUMENTS

| | | | | |
|---|---|---|---|---|
| GB | 2158794 | A * | 11/1985 | B61B 13/04 |
| NL | EP 0078085 | A1 * | 5/1983 | B66C 9/02 |

* cited by examiner

LIFTING DEVICE WITH AN ADJUSTABLE CARRIAGE

CROSS REFERENCE TO RELATED APPLICATION

The present patent application is based upon and claims the benefit of PCT/EP2011/073229, filed Dec. 19, 2011; which is based on German patent application nos. 10 2010 061 462.9; filed Dec. 22, 2010, and 20 2010 013 182.0; filed Dec. 22, 2010.

TECHNICAL FIELD OF THE INVENTION

The invention relates to a lifting device comprising a carriage, in particular a one-rail underflange carriage.

BACKGROUND OF THE INVENTION

Carriages for hoists are also referred to as crane trolleys or as trolley traveling winches. Different embodiments of these have been known. Underflange carriages frequently have two lateral shields which, respectively, support two running wheels, wherein the lateral shields are connected to each other by bolts. It is also possible to mount the load, e.g., in the form of a chain block hoist, to the bolt. Such a carriage is known, for example, from publication DE 10 2004 009 062 A1.

The corresponding running rails exist in different flange widths. Therefore, it is desirable on the part of the manufacturer of hoists to be able to adapt the carriages to different running rails, i.e., different flange widths.

To accomplish this, the cited publication DE 10 2004 009 062 A1 comprises a spacing option between the two lateral shields. To do so, the two lateral shields are connected to each other by means of a bolt-shaped crossbeam, in which case the lateral shields are adjustably supported on said crossbeam. Securing elements in the form of adjustment rings are provided, whereby these can be axially fixed on the crossbeam bolt in order to avoid any unintentional shifting of the lateral shields.

Publication WO 2009/156587 A1 also discloses a carriage with two lateral shields, wherein their relative distance from each other can be adjusted. The lateral shields engage with hook-type extensions in a suspension groove that is provided in the housing of the lifting gear. A threaded adjustment bar 9 is provided for adjusting the distance of the two lateral shields, said threaded adjustment bar connecting the two lateral shields. A rotation of this threaded adjustment bar adjusts the distance between the lateral shields.

Publication EP 0 912 383 B1 also discloses a trolley traveling winch with adjustable track width. Threaded rods connect the two lateral jaws with one another and allow the adjustment of the track width. To so, the threaded rods extend through appropriate openings on the lateral jaws, at which openings said rods are then secured by nuts that are tensioned against one another.

Publication GB 2 128 566 A discloses a carriage with adjustable track width. Again, a threaded spindle is provided for adjustment, said spindle being rotatably supported on a lateral shield yet axially rigidly supported and extending into a threaded bore of the opposing lateral shield. The track width can be adjusted by rotation of the spindle. A load is suspended centered from both lateral shields via pivotable brackets. Referring to this design, the suspended load is automatically centered. However, this requires a relatively high space for construction that results in lifting height losses in the case of hoists and is undesirable.

It has been found that, referring to lifting device, it is of importance that the pulling means extending from the hoist downward for lifting loads be located within relatively narrow limits in the center plane of the running rail. This must be taken into consideration in all adaptations of the track width of a trolley. Consequently, the track adjustment requires that appropriate care be exercised by personnel entrusted with this.

Publication U.S. Pat. No. 1,151,226 discloses a carriage that moves at the bottom of an I-profile bearing rail. The carriage comprises two side parts that rotatably support running wheels, said wheels running on the lower flange of the bearing rail. The two side parts are connected by a threaded bolt that, for distance adjustment, is screwed, with the right-hand thread, into one of the side parts and, with the left-hand thread, into the other of the side parts. Between the side parts, a section of the bolt is exposed. There, it is provided with an annular groove from which a load-bearing bracket can be suspended. By rotating the bolt, it is possible to adjust the distance of the side parts from one another within limits, in which case the load-bearing bracket always remains centered. However, the bolt is subject to bending stress.

SUMMARY OF THE INVENTION

Considering this, it is the object of the invention to provide a lifting device that can be adjusted for various running rails or track widths particularly easily and with reduced susceptibility to errors.

This object is achieved with the lifting device in accordance with claim 1:

The lifting device in accordance with the invention comprises a carriage and a lifting unit which are connected to each other by means of a linear guide arrangement, wherein a distance adjustment device for adjusting the distance of the side parts of the carriage is provided and wherein a centering arrangement ensures, in conjunction with this, that the side parts are moved, relative to the lifting unit, during each adjustment relative to the lifting unit, at the same distance toward each other or away from each other. Thanks to the centering arrangement it is thus ensured that, independent of the adjusted track width, the load carried by the lifting unit is suspended centered under the running rail. In this manner, the tilting moments that could occur with an asymmetrical adjustment could be minimized or avoided. As a result of the direct connection between the lifting unit and the carriage by means of a linear guide arrangement it can be ensured that no additional vertical construction space is used for the centering arrangement. Consequently, the lifting device according to the invention provides the same lifting height as a lifting device that is not self-centering.

The linear guide arrangement enables the adjustment of the side parts in a direction transverse to the traveling direction as defined by the carriage. In so doing, the adjustment direction is horizontal. The distance adjustment of the side parts is thus accomplished without changing the height position of the hoist.

The linear guide arrangement for connecting the side parts with the lifting unit preferably comprises one or two rib-like consoles or a corresponding groove, preferably provided on the housing of the lifting unit, wherein hook-type extensions of the side parts reach under said groove. In doing so, the side parts are preferably configured as bent sheet metal components. Preferably, a side part is configured as a flat sheet metal part which, in side view, is approximately rectangular and on whose vertical edges it is bent at a right angle. Extending from the angled parts, there are sections that extend in parallel to one another in downward direction, said sections being angled toward each other on their lower ends. The angled parts engage as hooks in the groove or extend under the console of the housing. Preferably, the consoles or grooves are arranged so as to extend away from one another relative to the traveling direction on front and rear walls of the housing. It is also possible, to use other linear guide arrangements in other configurations. For example, the housing of the lifting unit may be carried by loop-shaped belts that extend under the housing and whose ends are connected to the side parts. It is also possible to provide only a groove, e.g., a T-shaped groove, as the linear guide, said groove extending centrically over the top of and transversely across the housing.

The housing of the lifting unit is preferably an aluminum housing. In order to ensure that the side parts can be shifted easily and without jamming on the housing or in order to increase the bearing capacity, it is useful to appropriately armor the side of the console facing the hook. This may be accomplished with a steel rail that is arranged below the console. It is also possible to arrange such a steel rail in a groove in order to protect the groove flank and to offer an abutment surface for the hook.

The distance adjusting device and the centering device can be implemented in a single adjustment device. For example, this is a threaded spindle that has on its one end a right-hand thread and on its other end a left-hand thread. While the right-hand thread is in communication with a side jaw, the left-hand thread is in engagement with a corresponding left-hand thread of the other side jaw. At a suitable point, for example in the center or also at one end, the threaded rod is axially rigidly connected, however, rotatably connected with the housing of the lifting device. As a result of this, the two side parts are symmetrically adjusted with respect to each other when the threaded spindle is rotated.

Alternatively, the threaded rod may be divided, in which case the rotation of the two partial rods is preferably counter-rotational. The two partial rods may be supported so as to be rotatable, however axially not shiftable. Each may be provided with a cogged wheel, in which case the cogged wheels mesh with one another and thus effect the desired counter-rotation. In this case, both the partial rods may be provided with a right-hand thread and be screwed into the corresponding threaded holes of the two side parts.

Modified designs of the adjustment device and the centering device are possible. For example, the adjustment device may be a threaded spindle that is screwed to only one of the side parts and is supported axially rigidly, but rotatably, in the other side part. The two side jaws can be centered relative to the housing of the lifting unit via a link mechanism. Preferably, the levers of this link mechanism are located on a horizontal plane, e.g., between the threaded spindle and the housing of the lifting unit. In this manner, it is possible to accommodate a centering device without any additional space bring required between the lateral jaws.

Additional details of advantageous embodiments of the invention are the subject manner of the description of the claims and of the drawings.

The description hereinafter is restricted to the details necessary for an understanding of the embodiments and, in so doing, assumes the usual understanding of the art from the viewpoint of an inclusion of design details.

Other objects and advantages of the present invention will become apparent to those skilled in the art upon a review of the following detailed description of the preferred embodiments and the accompanying drawings.

IN THE DRAWINGS

The drawings show in

Figure 2:
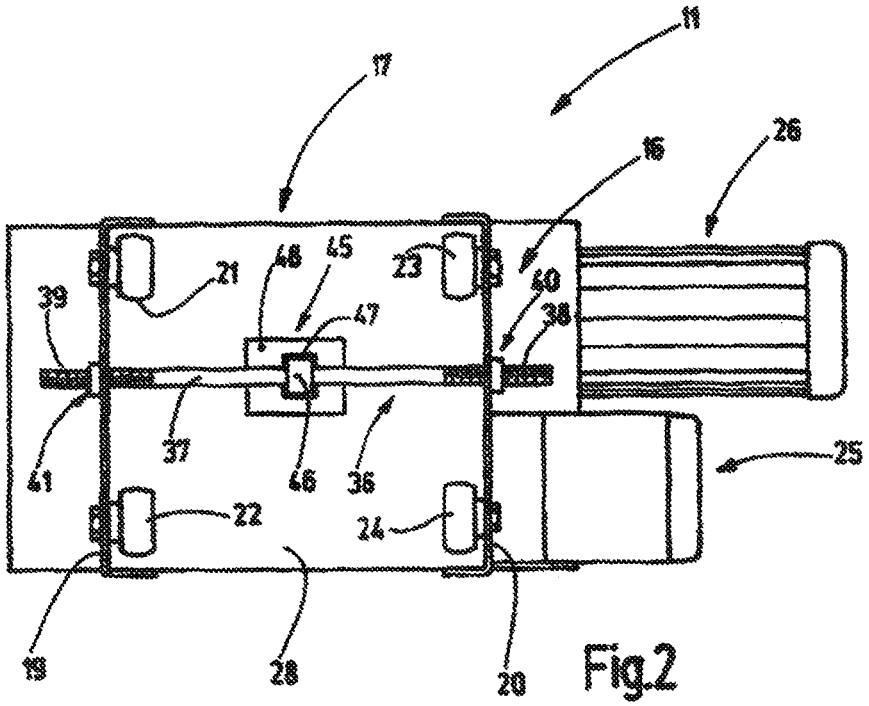
Figure 3:
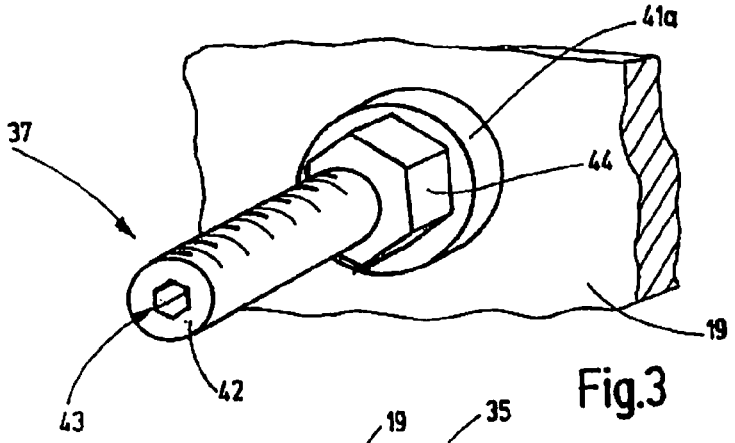
Figure 4:
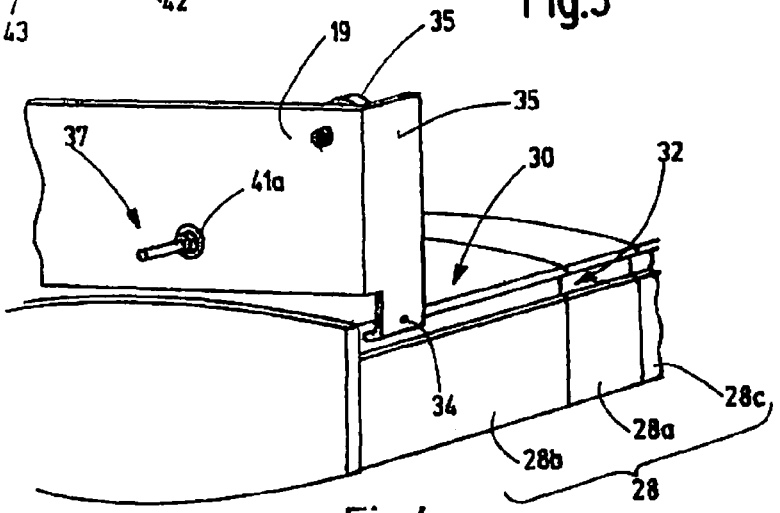
Figure 5:
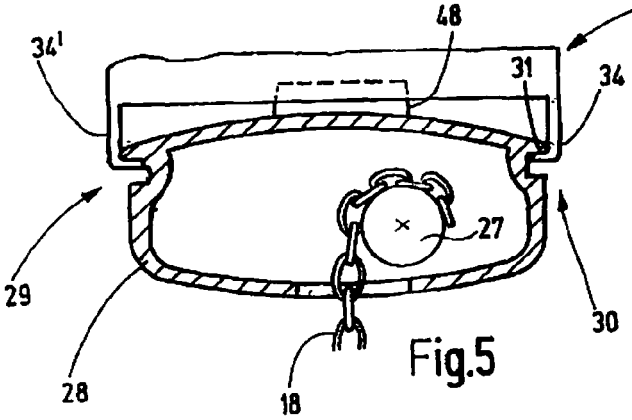
Figure 6:
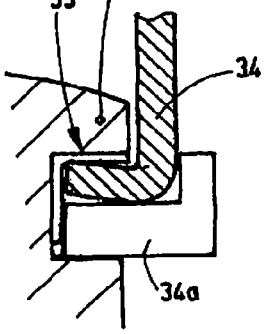
Figure 7:
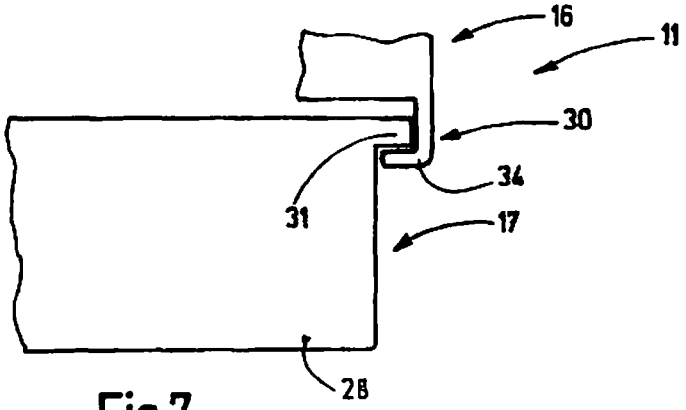
Figure 8:
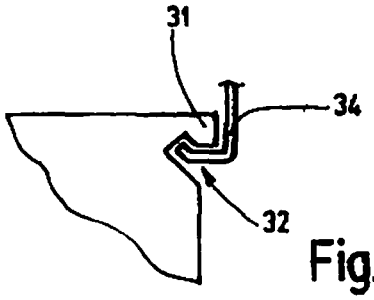
Figure 9:
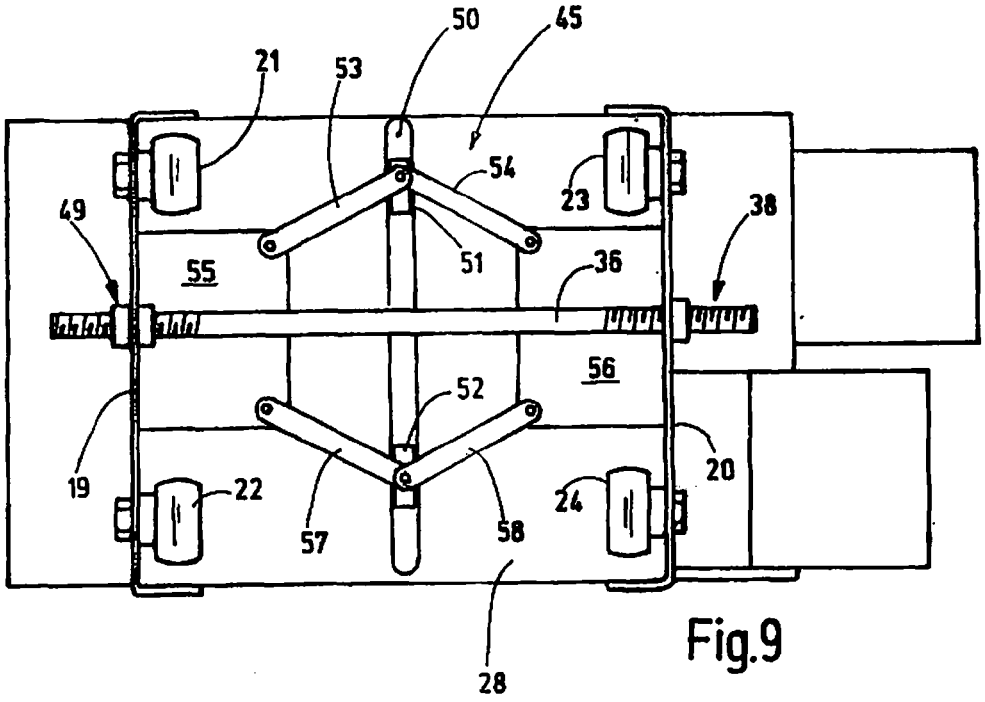
Figure 11:
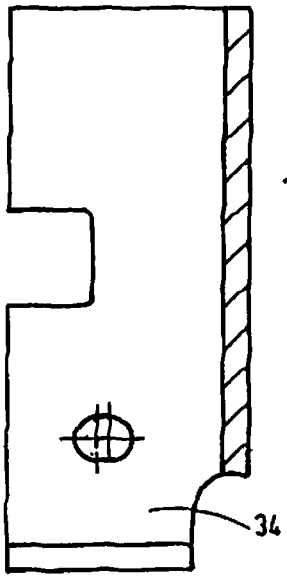
Figure 10:
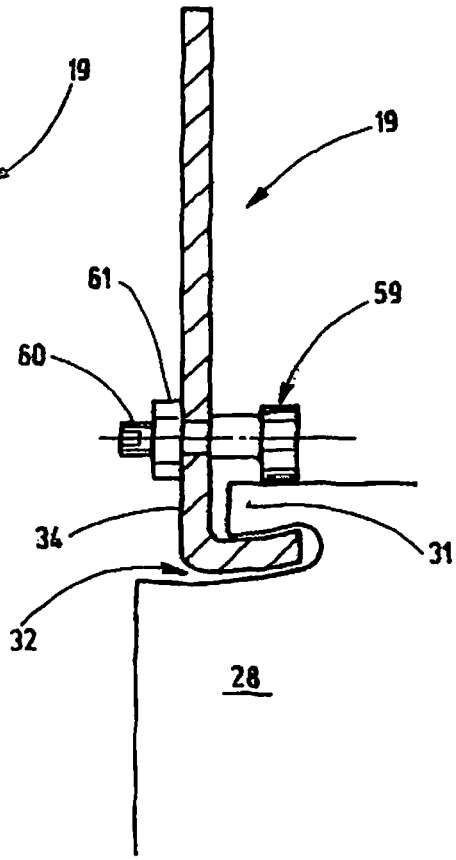
Figure 12:
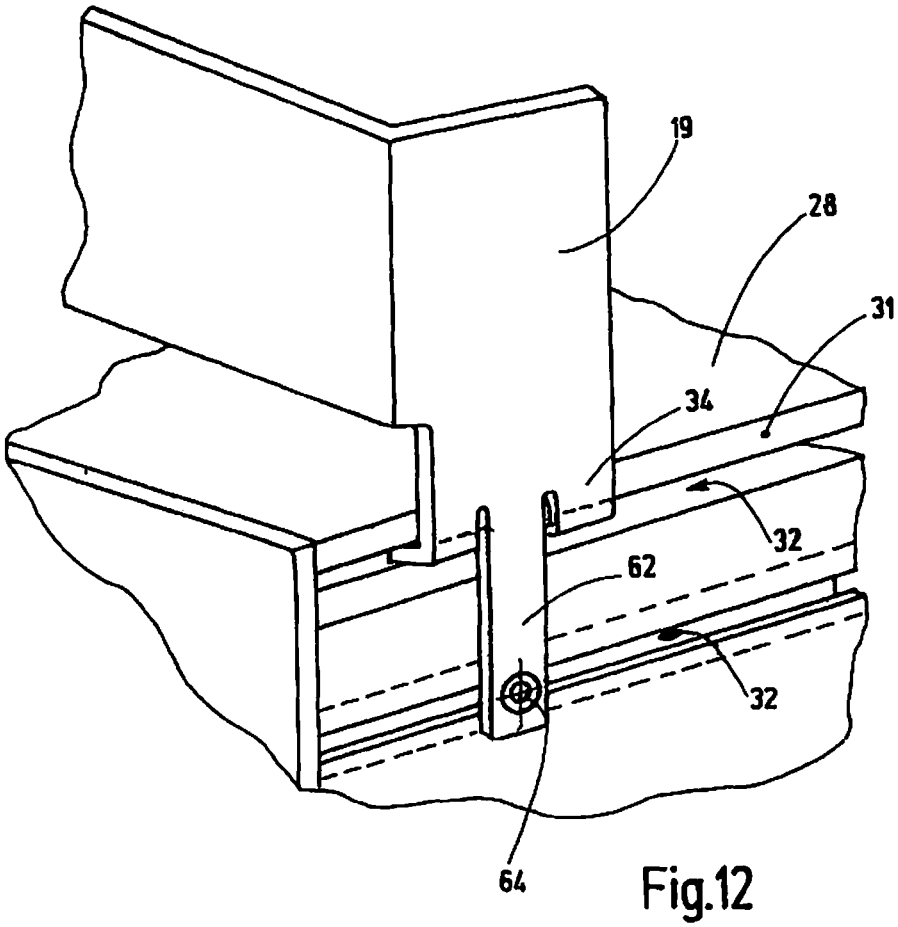
Figure 13:
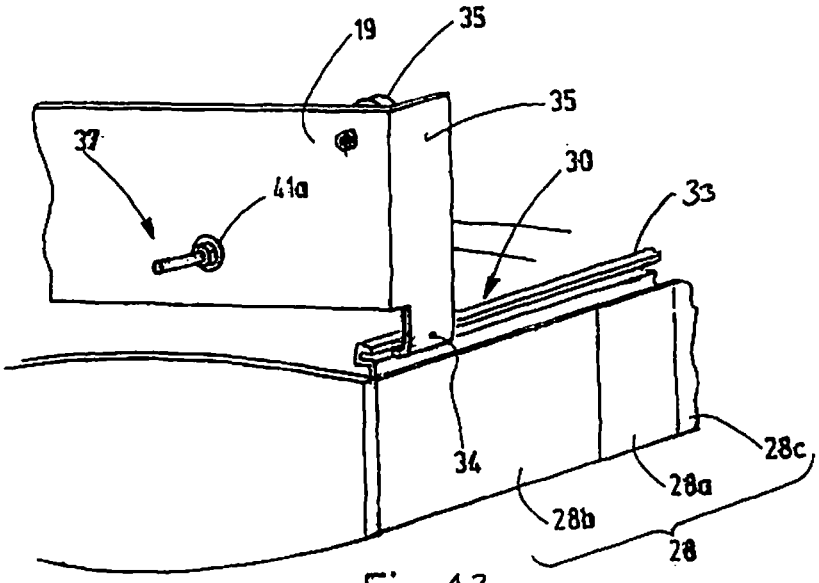
Figure 14:
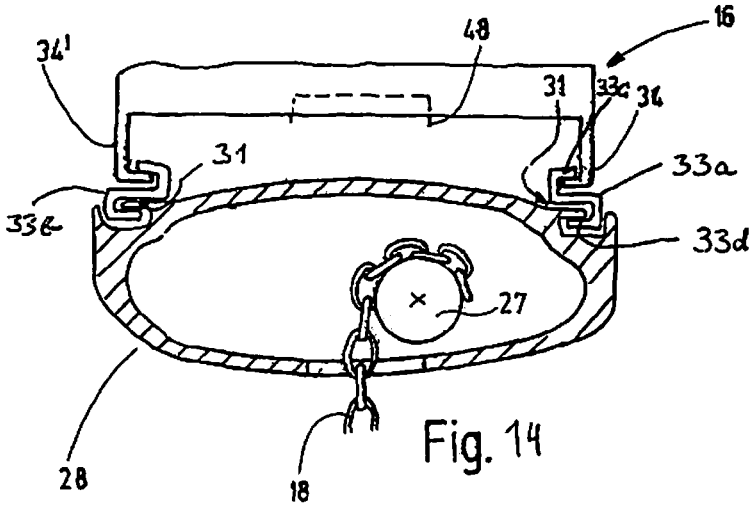

FIG. 1 a perspective, schematic representation of a lifting device on a running rail;

FIG. 2 a simplified plan view of the lifting device as in claim 1;

FIG. 3 a perspective view of a detail of a side jaw, with the threaded spindle;

FIG. 4 a detail of a perspective representation of the lifting unit and a side jaw of the carriage of the lifting device;

FIG. 5 a detail of a sectional representation of the lifting unit and the carriage as in FIGS. 1 and 4;

FIG. 6 a detail of FIG. 5;

FIGS. 7 and 8 different embodiments of the detail in accordance with FIG. 6;

FIG. 9 a schematized plan view of a modified embodiment of a lifting device in accordance with the invention;

FIG. 10 a detail of a sectional representation of a modified embodiment of a side part and a housing;

FIG. 11 a vertical sectional view of the side part as in FIG. 10;

FIG. 12 a perspective view of a detail of a modified embodiment of a lifting device;

FIG. 13 a perspective view of a detail of another modified embodiment of a lifting device; and FIG. 14 a sectional view of the lifting device as in FIG. 13.

DETAILED DESCRIPTION OF THE INVENTION

FIG. 1 shows a crane rail 10 comprising a lifting device 11 that can be moved thereon. The lifting device 11 is disposed for lifting and moving not specifically shown loads. FIG. 1 shows a hook 12 provided therefor.

A cane rail 10 comprises an upper and a lower flange 13, 14 that are connected to each other by means of a vertical bar 15. The latter defines a vertical longitudinal center plane. The crane rail 10 has a given width that is defined by the width of the lower flange 14. The lifting device 11 can be adapted to crane rails having flanges 14 of different widths. For this purpose, the lifting device comprises a correspondingly adjustable carriage 16 that carries the lifting unit 17. The lifting unit 17 carries the hook 12 by means of a chain 18 or another pulling means such as, for example, a rope, a belt or the like.

FIG. 2 shows a schematic plan view of the lifting device 11. The carriage 16 comprises two lateral parts 19, 20 that are preferably arranged parallel to one another at an adjustable distance. Each of the lateral parts 19, 20 supports at least one, preferably two, running wheels 21, 22, 23, 24, these being rotatably supported on the lateral parts 19, 20. They are disposed to run on the upper side of the flange 14.

At least one of the running wheels 21-24, in the present exemplary embodiment running wheel 24, is connected to a travel drive 25. This drive comprises, e.g., a motor control gear unit that can be appropriately remote-controlled in order to effect a targeted travel motion of the lifting device 11 on the crane rail 10. The travel drive 25 can act, for example, via not further illustrated cogged wheels on additional wheels of the same side part 20, i.e., preferably wheel 23. The running wheels 21, 22 follow without being driven. However, it is possible to also assign drives to these running wheels 21, 22.

The load is lifted by a lifting drive 26 that acts, for example, on a chain sprocket 27 indicated in FIG. 5. The lifting drive 26 is preferably flanged to a lateral front surface of the lifting unit 17.

The lifting unit 17 comprises a housing 28 or another base support that, one the one hand, supports the lifting drive 26 and, on the other hand, supports the chain sprocket 27, a rope drum or the like. The housing 28 may consist, for example, of one center part 28*a* and two side closures 28*b*, 28*c* (FIG. 4), that are flanged to the center part 28*a* on the front side. The drive with the chain sprocket and the flange-connected motor are arranged on the center part 28*a*. Preferably (but not necessarily), the side closures 28*b*, 28*c* have the shape of a cup or also of a profile tube and accommodate the motor and the drive as well as, optionally, a control. The housing 28 is connected by at least one, preferably two, linear guides 29, 30 to the carriage 16. The linear guides 29, 30 are arranged on sides of the housing 28, said sides facing away from each other and being symmetrical with respect to each other. Therefore, the description of the linear guide 30 hereinafter applies, correspondingly, to the linear guide 29.

As is obvious in particular from FIG. 4, the linear guide 30 comprises a console 31 that is obvious from FIGS. 5 and 6, said console extending as a horizontally extending rib with, e.g., a horizontal lower surface, from the housing wall of the housing 28. The console 31 may also be a part of the limitation of a groove 32 that extends below the console 31 horizontally over the vertical front wall or rear wall of the housing 28. The console 31 and/or the groove 32 may extend over the center part and the side closures of the housing 28.

Preferably, the console 31 is armored. If the housing 28 consists of aluminum, this may be accomplished with a bar 33 consisting of, e.g., steel (e.g., a smooth-drawn or also a ground and polished metal sheet), said bar being placed in the groove 32 or under the console 31. The rail 33 may be a flat rail, an angled rail, have a round profile, or be otherwise configured to fit the purpose.

Furthermore, the linear guide 30 comprises a hook-type extension 34 that extends downward from an angled wall 35 (FIG. 4) of the side part 19. The hook-type extension 34 extends under the console 31, as is particularly obvious from FIG. 6. If necessary, the extension 34 can be stationarily secured with a clamping piece 34*a*. The clamping piece may have the shape of a wedge and be held with corresponding, not specifically illustrated, mounting means such as screws, bolts, clamping jaws or the like, in the groove 32. Alternatively, the console, e.g., may have a series of threaded bores that are associated with clamping screws for fastening the extension 34. Alternative clamping options for the potentially needed fixation and release of the linear guide arrangement 30 are possible. It is also possible for the extensions to extend under the housing and thus make the console 31 superfluous. Also in this case, linear guiding is achieved by the movability of the extensions along the housing 28.

The side part 19 has also such an extension 34' on the opposite side for the linear guide 29. Furthermore, the side parts 19, 20 are configured so as to be symmetrical to one another, so that the description for the side part 19 applies, correspondingly, to the side part 20 and its extensions.

FIG. 2 shows a distance adjustment device 36 which can be used to adjust the side parts 19 and 20 toward and away from one another. The distance adjustment device 36 comprises a threaded spindle 37 having, on its one end, a right-hand thread 38 and, on its other end, a left-hand thread 39. The right-hand thread 38 is screwed into a corresponding threaded opening 40 that is provided on the right side part 20, e.g., configured as a bushing. The left-hand thread 39 is screwed to a threaded opening 41 that is provided on the side part 19 or on a bushing 41*a* connected therewith. The bushing 41*a* is welded or otherwise connected to the side part 20. Preferably, its length exceeds its diameter. Preferably, the length is at least twice or three times the internal diameter. As a result of this, the threaded spindle guides the side parts in parallel. The front-side end of the threaded spindle 27 may have a coupling opening 43 where a tool can be attached, for example, a hexagon wrench. Furthermore, one or more counternuts 44 may be seated on the threaded spindle 37 in order to optionally secure the threaded spindle 37 in a torque-proof manner.

Furthermore, the carriage 16 comprises a centering device 45 that is shown in an exemplary manner by FIG. 2. In this simple exemplary embodiment, the centering device 45 consists of a collar or of a radial flange 46 that is seated on the threaded spindle 37 so that it cannot be axially shifted. The radial flange 46 engages in a recess 47 that is provided in a housing projection 48 (see FIGS. 2 and 5). The housing projection 48 can be located centered on the upper side of the housing 28.

In the exemplary embodiment of FIG. 2, the radial flange 46 is configured so as to be centered on the threaded spindle 37 and fixes the threaded spindle 37 to the housing 28, i.e., rotatably, yet immovably in axial direction. Instead of the presented solution, it is also possible to provide other fixation options, for example, a roller bearing of the threaded spindle 37 on the housing 28. In addition, the fixation need not necessarily be centric. It may just as well be provided on one end of the threaded spindle 37. Essential is that an axial adjustment of the threaded spindle 37 relative to the housing 28 is prevented.

The adjustment of the track width is accomplished by rotating the threaded spindle 37. As a result of this, the side parts 19, 20 are moved toward one another and away from another. With reference to the housing projection 48, the stroke width of the right and the left housing parts 19, 20 is uniform. This is because the pitches of the threads 38, 39 are the same but have reversed signs.

Due to the axial fixation of the threaded spindle 37, the lifting unit 17 remains centered with respect to the running rail 10. The chain 18 does not move out of the plane prespecified by the bar 15.

If the carriage 16 is set to the desired track width, the threaded spindle 37 can be secured with the counternut 44 and, optionally, additional counternuts. In addition, the extensions 34 can be stationarily secured by clamping pieces 34*a* or by other means.

Several modifications are possible on the presented lifting device 11. FIG. 7, for example, shows a housing 28 that comprises, instead of a groove, only the console 31, in which case the extension 34 extends under said console. FIG. 8 shows an example clarifying the circumstance that the underside of the console 31 need not necessarily be flat or planar. Optionally, the groove 32 may also comprise an undercut. This measure holds the extension 34 in a particularly secure manner in the groove 32.

Whereas, in the aforementioned exemplary embodiment, the centering device 45 and the distance adjustment device 36 were configured as the threaded spindle 37 provided with the radial flange 46 on one and the same machine part, it is also possible to separate these functions. FIG. 9 shows such an exemplary embodiment. Again, a threaded spindle 37 is provided which, however in this case, has the right-hand thread 38 only on its right end. The left end is rotationally held in axial direction in a bearing 49, said bearing being provided on the side part 19.

For centering, the centering device 45 in this case is represented by a lever mechanism. A groove 50 extending along the upper side is provided on the housing 28. The groove 50 is oriented tansversely to the threaded spindle 37. The longitudinal direction of the groove 50 matches the traveling direction prespecified by the running wheels 21-24.

One or two sliding blocks 51, 52 move in the groove 50. The sliding block 51 is hinged, via two pivot arms 53, 54, to the side parts 19, 20 provided on the plates 55, 56. Also, the sliding block 52 is connected to the plates 55, 56 via the pivot arms 57, 58. If the side parts 19, 20 are adjusted toward each other or away from each other by actuating the threaded spindle 37, i.e., by targeted rotation of said spindle, the sliding blocks 51, 52 are shifted toward one another or away from one another in the groove 50. In doing so, they keep the side parts 19, 20 at the same distance from the center groove via the pivot arms 53, 54 and 57, 58, respectively.

Instead of the shown threaded spindle 37 that bears only the right-hand thread 38, it is also possible to use a threaded rod with a uniform thread, said rod extending through the holes of the side parts 19, 20. The side parts 19, 20 can then be secured to the threaded spindle by means of nuts and thus maintained at the desired distance. It is also possible to use a threaded spindle 37 with a right-hand thread 38 and a left-hand thread 39, as has been previously described in conjunction with FIGS. 1 through 8. However, this threaded spindle is then not axially fastened to the housing 28. Centering is achieved via the separate centering device 45. The spindle 37 acts only as the distance adjustment device.

FIGS. 9 and 10 are schematized illustrations of an alternative embodiment of the side part 19 and the housing 28. Accordingly, the side part 20 is configured so as to be mirror-symmetrical to the side part 19. The side part 19, in turn, has the projection 34 that is angled on the underside and thus has a slightly ascending section. The latter also extends into the slightly ascending groove 32. For firmly holding the lateral part 19 in a desired sliding position, a suitable clamping means may be provided. Preferably, the clamping means acts from the top on the console 31; consequently the console 31 is tensioned between the angled extension and the clamping means. The clamping means may be an eccentric 59, for example, said eccentric being supported by the bolt 60 extending through the side part 19. The bolt 60 may be secured against rotation by a counternut 61. The counternut 61 is screwed onto the bolt, tensioning said bolt relative to the side part 19.

By targeted rotation of the bolt 61, the eccentric 59 that is connected to the bolt 60 can be firmly non-rotationally tensioned or released relative to the console 31.

FIG. 12 illustrates another embodiment of the side part 19 (and correspondingly specularly reversed side part 20) and the housing 28. As already mentioned, the latter may comprise one or more parts. Referring to the description hereinabove, the already introduced reference signs apply correspondingly. The following applies in addition: The extension 34 is provided with a finger 62. This finger extends downward over the groove 32 and over a second groove 63 that is arranged parallel to the first groove 32. Preferably, the groove 63 is configured as an undercut groove 63. Not specifically illustrated sliding blocks with one threaded bore, respectively, or also other fastening or anchoring means may be arranged in the groove 63. Such sliding blocks are arranged in the groove 63 so that they are preferably easily slidable.

The finger 62 has on its lower end, for example, a bore 64 in alignment with the groove 63. A screw can be screwed through this bore into the threaded bore of the sliding block. When this screw is tightened, the slightly elastic finger 62 is pressed against the housing. The screw and the finger 62 secure the side part 19 (20) immovably and tightly on the housing 28. After releasing the screw, the side part can be adjusted along the grooves 32, 63 by actuating the distance adjustment device 36 that may be provided in one of the previously described embodiments.

FIGS. 13 and 14 illustrate another embodiment of the lifting device 11. To the extent that the structural and functional features are the same as in the aforementioned embodiments, the introduced reference signs are used in the same manner. The previous description applies, especially in view of all of the embodiment options and alternatives, in particular with respect to the distance adjustment device 36.

The modification of the lifting device 11 according to FIGS. 13 and 14 consists in the embodiment of the rail 33. This rail is configured as a hooked rail 33*a*, 33*b* or also as a z-rail. Its length corresponds to the respective length of the housing. In cross-section, it is z-shaped or hook-shaped. One lower leg of said rail extends under the console 31. Its upper leg is seated on the extension 34. In this manner, a stable design with a large-area load-introduction into the housing 28 is ensured. The hook rail 33*a*, 33*b* is preferably made of steel. It may be provided as a milled component or as a bent sheet metal component. It represents a holding profile that is securely seated in the console 31. Preferably, the upper part forms a hook head 33*c* that is horizontally offset relative to a lower hook foot 33*d*. In so doing, the extension 34 can be located vertically exactly above the console 31. The hook rail 33*a*, 33*b* is thus torque-free and transmits only pulling forces. However, it may also be desirable and useful to provide a horizontal offset between the hook head 33*c* and the hook foot 33*d*. In this manner, the introduction of force into the console can be optimized.

The lifting device 11 according to the invention comprises a carriage 16 and a lifting unit 17, which are connected to each other by means of linear guides 29, 30. The carriage 16 comprises two side parts 19, 20 that can be adjusted in view of their distance relative to each other by means of a distance adjustment device 36. In doing so, they are centered by means of a centering device 45 with respect to the lifting unit 17, in particular with respect to the pulling means originating from the lifting unit 17.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

LIST OF REFERENCE SIGNS

10 Crane rail
11 Lifting device
12 Hook
13 Upper flange of the crane rail 10
14 Lower flange of the crane rail 10
15 Center bar
16 Carriage

17 Lifting unit
18 Chain
19 Left side part
20 Right side part
21-24 Running wheels
25 Travel drive
26 Lifting drive
27 Chain sprocket
28 Housing
29, 30 Linear guide
31 Console
32 Groove
33 Rail
33*a*, 33*b* Hook rail
34, 34' Extension
34*a* Clamping piece
35 Wall
36 Distance adjustment device
37 Threaded spindle
38 Right-hand thread
39 Left-hand thread
40 Threaded opening with right-hand thread
41 Threaded opening with left-hand thread
41*a* Bushing
42 End
43 Coupling opening
44 Counternut
45 Centering device
46 Radial flange
47 Recess
48 Housing projection
49 Bearing arrangement
50 Groove
51, 52 Sliding block
53, 54 Pivot arm
55, 56 Plates
57, 58 Pivot arm
59 Eccentric
60 Bolt
61 Nut
62 Finger
63 Groove
64 Bore

The invention claimed is:

1. Lifting device (11) comprising, a carriage (16) comprising two lateral side parts (19, 20), each with at least one running wheel (21 - 24) configured for running on an upper side of a lower flange (14) of a vertical bar (15), the lower flange (14) having a predetermined width, a lifting unit (17) bearing a pulling means (18) that is height-adjustable for receiving loads, the lifting unit (17) comprising a pair of oppositely disposed linear guide arrangements (29, 30), the two lateral side parts (19, 20) of the carriage (16) are each respectively operatively connected to one of the linear guide arrangements (29, 30) of the lifting unit (17) in a bearing manner, the carriage (16) further comprises a distance adjustment device (36) configured to adjust the distance of the two lateral side parts (19, 20) from one another and a centering device (45) configured to produce equally large, oppositely directed adjustment movements of the two lateral side parts (19, 20), relative to the predetermined width of the lower flange (14) and to center the pulling means (18) with respect to the predetermined width of the lower flange (14).

2. Lifting device as in claim 1, characterized in that the carriage (16) comprises at least one travel drive (25) that is connected in a driving manner to at least one of the wheels (24).

3. Lifting arrangement as in claim 1, characterized in that the side parts (19, 20) are bent sheet metal parts.

4. Lifting arrangement as in claim 1, characterized in that the lifting unit (17) comprises a housing (28) on which is provided a console (31) that is associated with the linear guide arrangement (30).

5. Lifting device as in claim 4, characterized in that a rail (33), made of steel, is provided on the console (31).

6. Lifting device as in claim 4, characterized in that the lifting unit (11) comprises a housing (28) that is provided with a groove (32) that belongs to the linear guide arrangement (30).

7. Lifting device as in claim 4, characterized in that at least one hook-type extension(34) is provided on each side part (19, 20), said hook-type extension extending under the console (31) in order to support the lifting unit (17).

8. Lifting device as in claim 7, characterized in that the extension (34) can be moved along the console (31).

9. Lifting device as in claim 1, characterized in that a centering device (45) is connected to the lifting unit (17).

10. Lifting device as in claim 9, characterized in that the centering device (45) is configured so as to be a component of a distance adjustment device (36).

11. Lifting device as in claim 10, characterized in that the distance adjustment device (36) comprises a threaded spindle (37) having at least one thread (38).

12. Lifting device as in claim 11, characterized in that the threaded spindle (37) is in engagement with a threaded bushing (41*a*) that is rigidly connected to one of the side parts (19, 20).

13. Lifting device as in claim 10, characterized in that the distance adjustment device (36) comprises a threaded spindle (37) with a right-hand thread (38) and a left-hand thread (39), wherein the right-hand thread (38) is in engagement with a thread (40) associated with one of the side parts (20), whereas the left-hand thread (39) is in engagement with a thread (41) associated with the other side jaw (19).

14. Lifting device as in claim 13, characterized in that the threaded spindle (37) is axially rigidly connected to the lifting unit (17).

15. Lifting device as in claim 10, characterized in that the distance adjustment device (36) comprises a threaded spindle (37) that is axially rigidly connected to one of the side parts (19, 20).

* * * * *